US009679466B2

(12) United States Patent
Hogg

(10) Patent No.: US 9,679,466 B2
(45) Date of Patent: Jun. 13, 2017

(54) PERSONAL SAFETY DEVICE AND A HARNESS FOR BREATHING APPARATUS

(71) Applicant: Draeger Safety UK Limited, Blyth, Northumberland (GB)

(72) Inventor: Christopher Simon Hogg, Whitley Bay (GB)

(73) Assignee: Draeger Safety UK Limited (GB)

( * ) Notice: Subject to any disclaimer, the term of this patent is extended or adjusted under 35 U.S.C. 154(b) by 108 days.

(21) Appl. No.: 14/769,993

(22) PCT Filed: Feb. 25, 2014

(86) PCT No.: PCT/GB2014/050567

§ 371 (c)(1),
(2) Date: Aug. 24, 2015

(87) PCT Pub. No.: WO2014/132050

PCT Pub. Date: Sep. 4, 2014

(65) Prior Publication Data

US 2016/0005303 A1 Jan. 7, 2016

(30) Foreign Application Priority Data

Feb. 26, 2013 (GB) ..... 1303407.9

(51) Int. Cl.
*G08B 1/08* (2006.01)
*G08B 25/01* (2006.01)
(Continued)

(52) U.S. Cl.
CPC ..... *G08B 25/016* (2013.01); *A62B 9/006* (2013.01); *G08B 3/10* (2013.01); *G08B 21/04* (2013.01);
(Continued)

(58) Field of Classification Search
CPC .. A62B 9/006; A62B 7/02; A62B 7/00; G08B 21/0415; G08B 21/216; G08B 21/02
(Continued)

(56) References Cited

U.S. PATENT DOCUMENTS 4,914,422 A 4/1990 Rosenfield et al.
4,926,159 A 5/1990 Bartlett
(Continued)

FOREIGN PATENT DOCUMENTS

EP 0801368 4/1997
WO 03/013354 2/2003

OTHER PUBLICATIONS

International Preliminary Report on Patentability and Written Opinion issued in Corresponding PCT Application No. PCT/GB14/050567.

(Continued)

*Primary Examiner* — Hoi Lau
(74) *Attorney, Agent, or Firm* — DLA Piper LLP (US)

(57) ABSTRACT

A personal safety device, comprising: a housing; attachment means provided on the housing, the attachment means being configured to receive a strap so as to attach the device to a wearer; a motion sensor arranged to monitor the motion of the wearer; and an alarm configured to be activated when the motion sensor has not detected motion for a predetermined period of time; wherein the alarm comprises a first sounder disposed within a first chamber formed by the housing, the first chamber having a first outlet passage; wherein the first outlet passage is arranged such that, in use, it is aligned with a longitudinal axis of the strap.

24 Claims, 8 Drawing Sheets

(51) Int. Cl.

| | |
|---|---|
| ***G08B 3/10*** | (2006.01) |
| ***G08B 21/04*** | (2006.01) |
| ***G08B 25/12*** | (2006.01) |
| ***A62B 9/00*** | (2006.01) |
| ***G08B 25/00*** | (2006.01) |

(52) U.S. Cl.
CPC ..... *G08B 21/0415* (2013.01); *G08B 21/0446* (2013.01); *G08B 25/001* (2013.01); *G08B 25/002* (2013.01); *G08B 25/12* (2013.01)

(58) Field of Classification Search
USPC ..... 340/539.11, 573.1, 573.4, 521; 128/204.23, 202.13
See application file for complete search history.

(56) References Cited

U.S. PATENT DOCUMENTS 5,157,378 A * 10/1992 Stumberg ..... A62B 9/006 2/8.1
5,541,579 A * 7/1996 Kiernan ..... G08B 21/0415 200/51.09
5,848,576 A * 12/1998 Colaianni ..... A47D 13/086 119/770
5,923,255 A * 7/1999 Vahdatshoar ..... G08B 21/0216 340/573.1
5,949,337 A * 9/1999 Campman ..... G08B 21/02 128/202.22
6,091,331 A 7/2000 Toft et al.
6,199,550 B1 * 3/2001 Wiesmann ..... A62B 9/006 128/202.22
6,995,665 B2 * 2/2006 Appelt ..... G08B 21/182 128/204.23
7,019,652 B2 * 3/2006 Richardson ..... A62B 7/00 128/202.22
7,024,734 B2 * 4/2006 Anscher ..... A44B 11/266 24/591.1
7,340,809 B2 * 3/2008 Tracy ..... B60N 2/2812 200/61.58 B
8,085,144 B2 * 12/2011 Appelt ..... A61B 5/02055 128/201.22
D666,367 S * 8/2012 Miller ..... D30/152
D673,473 S * 1/2013 Hogg ..... D10/104.1
D709,780 S * 7/2014 Hogg ..... D10/104.1
D749,005 S * 2/2016 Bruce ..... D10/104.1
2010/0300436 A1 * 12/2010 McKeown ..... A62B 7/02 128/202.13
2011/0045795 A1 2/2011 Sacknoff
2011/0068944 A1 3/2011 Sacknoff
2013/0257612 A1 * 10/2013 Finet ..... A62B 9/006 340/539.11

OTHER PUBLICATIONS

International Search Report and Written Opinion from PCT/GB14/050567.
Search Report from corresponding GB Application No. 1303407.9 dated Jul. 5, 2013.
Combined Search and Examination Report dated Aug. 9, 2016, directed to corresponding GB Application No. 1611867.1 (5 pages).

* cited by examiner

PERSONAL SAFETY DEVICE AND A HARNESS FOR BREATHING APPARATUS

BACKGROUND

The invention relates to a personal safety device, and particularly, but not exclusively, to a personal safety device for monitoring a wearer of breathing apparatus. The invention also relates to a harness for breathing apparatus which may be used with a personal safety device.

Fire-fighters and other personnel entering hazardous (IDLH—Immediately Dangerous to Life and Health) environments often carry with them a personal safety device, known as a Personal Alert Safety System (PASS) or an Automatic Distress Signal Unit (ADSU).

Such personal safety devices typically comprise a motion sensor that monitors the motion of the wearer and an alarm, for example an audible or visual alarm, that is activated if motion is not detected for a pre-determined period of time. If no motion is detected it may indicate that the wearer is injured or incapacitated and therefore the alarm may alert rescue personnel (other fire-fighters, for example) to the location of the wearer. The device may also be capable of manual activation via a panic button if the wearer becomes distressed.

The design and performance of PASS devices is governed by national regulations and standards which are imposed and regulated by regulatory bodies. For example, in the United States (US), PASS devices must adhere to the standards set out in the National Fire Protection Association 1982 Standard (NFPA1982). Similar standards exist in other jurisdictions, for example, British Standard 10999 (BS10999) in the United Kingdom (UK).

NFPA1982 includes numerous requirements for the robustness of a PASS device and aims to represent the real life conditions that fire-fighters may be exposed to. Two of the conditions addressed in NFPA1982 are:

resistance of the device to being muffled when the wearer is in fallen positions; and ability of the device to operate when exposed to water.

Both of these conditions have the capability of reducing the sound level being emitted by the device. It must therefore be demonstrated, for compliance with NFPA1982, that in a muffle test and a water drainage test that the sound produced by the device is sufficiently loud even under these conditions.

PASS devices typically comprise one or more sounders each having a piezoelectric transducer. Vibration of the piezoelectric transducer produces sound which may be amplified using resonant cavities or sound chambers. If the outlet to the sound chamber is covered, by any physical means, then the sound level is reduced.

The water drainage test simulates the device being partially covered with water and attempts to cover the sounder (s), or sound chambers, with the most water possible to block the outlet(s) or rest on top of the sounder disc, thereby reducing the sound level. The piezoelectric discs typically used in sounders are flat to allow the piezoelectric material to bend from the horizontal plane. However, this flat surface is ideal for water to rest on and dampen the output level. The surface of the disc can be treated to reduce the surface tension, thus causing water to bead and run off the surface. Further, surfaces that are angled to allow water to run off are often deployed and the use of multiple sounders at suitable angles allow for this.

In the muffle test, the device must still meet the minimum sound level when the wearer is in each of the following five positions:

1. Face down with arms fully extended out to the sides;
2. Supine left as far as possible, arms down along sides;
3. Supine right as far as possible, arms down along sides;
4. Foetal, knees drawn to chest as far as possible, arms around legs, and lying on right side; and
5. Foetal, knees drawn to chest as far as possible, arms around legs, and lying on left side.

These positions simulate a fallen fire-fighter, where the device (i.e. the outlet of the sounder) may be muffled by the turn-out gear of the fire-fighter.

To satisfy this test, more than one sounder is typically used so that if the outlet of one sounder becomes blocked, the other sounder(s) will be free to function properly.

For sounders that are deployed on the fire-fighter's back (for example, on breathing apparatus), this is less of a problem as they can be mounted at points that do not come into contact with the fire-fighter's turn-out gear. However, when the sounders are mounted on the shoulder straps or waist straps, the outlets are particularly close to the turn-out jacket.

It is therefore desirable to provide a personal safety device which has an improved sounder arrangement which allows it to be mounted on a shoulder or waist strap.

SUMMARY OF THE INVENTION

An exemplary embodiment of the present invention comprises a personal safety device, that comprises a housing attachment means provided on the housing, the attachment means being configured to receive a strap so as to attach the device to a wearer; a motion sensor arranged to monitor the motion of the wearer; and an alarm configured to be activated when the motion sensor has not detected motion for a predetermined period of time, where the alarm comprises a first sounder disposed within a first chamber formed by the housing, the first chamber having a first outlet passage; wherein the first outlet passage is arranged such that, in use, it is aligned with a longitudinal axis of the strap.

Another exemplary embodiment of the present invention comprises a harness for breathing apparatus, the harness arranged to support a cylinder of breathable gas, the harness comprising a structural support member; a cylinder retaining mechanism for coupling the cylinder to the structural support member; and a sounder disposed in a chamber formed by the structural support member, where the chamber has first and second outlet passages extending in opposite directions from the sounder.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

Figure 1:
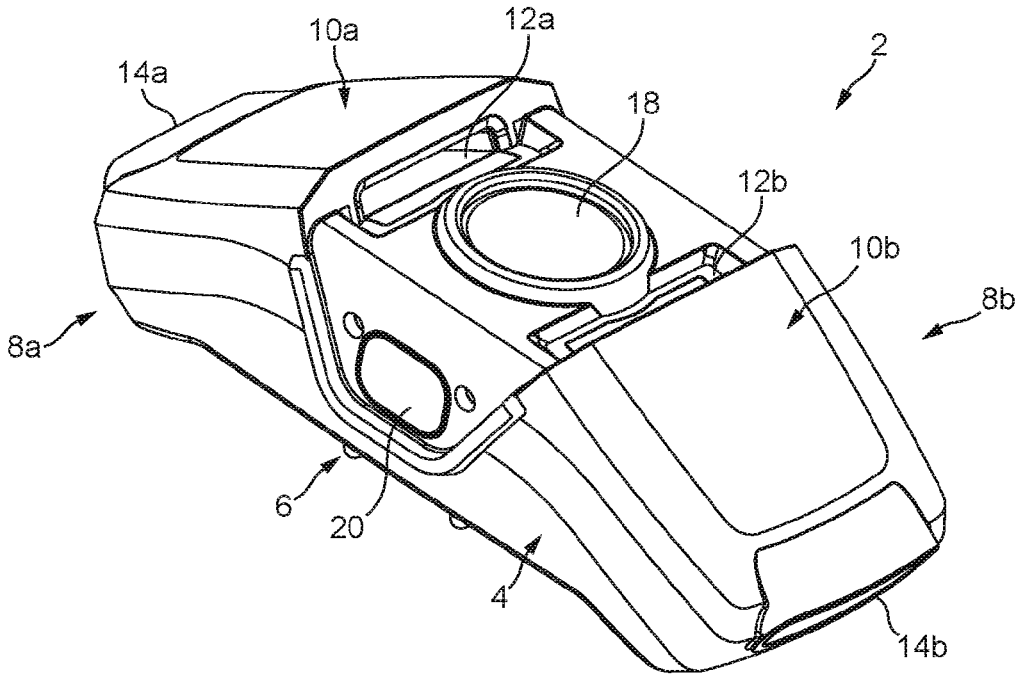
FIG. 1 is a perspective view of a personal safety device according to an embodiment of the invention.

In accordance with a first exemplary embodiment of the invention, there is provided a personal safety device, comprising: a housing; attachment means provided on the housing, the attachment means being configured to receive a strap so as to attach the device to a wearer; a motion sensor arranged to monitor the motion of the wearer; and an alarm configured to be activated when the motion sensor has not detected motion for a predetermined period of time; wherein the alarm comprises a first sounder disposed within a first chamber formed by the housing, the first chamber having a first outlet passage; wherein the first outlet passage is arranged such that, in use, it is aligned with a longitudinal axis of the strap.

The alarm may further comprise a second sounder disposed within a second chamber formed by the housing, the second chamber having a first outlet passage. The first outlet passage of the second chamber may be arranged such that, in use, it is aligned with a longitudinal axis of the strap.

The alignment of the outlet passages with the longitudinal axis of the strap may prevent the turn-out gear, particularly the jacket, of the wearer from covering the outlet passages. Further, since the chambers are aligned with the strap, they are not blocked by the folds of the turn-out jacket, either at the chest or at the waist, in any of the positions prescribed by the muffle test imposed by NFPA1982.

The first and second chamber may be inclined with respect to one another. For example, the first and second chambers may be inclined at 100 to 140 degrees, and more particularly at approximately 120 degrees.

As the first and second chambers are angled with respect to one another, water may drain from one of the chambers, regardless of the orientation of the personal safety device.

The angular arrangement of the chambers ensures that at least one of the sounders will self-drain during the water drainage test imposed by NFPA1982.

The first outlet passage of the first sounder may oppose the first outlet passage of the second sounder.

The opposing arrangement of the first and second sounders provides mutual protection to the outlet passages and prevents them from being obstructed by the turn-out gear of the wearer.

The first outlet passage of the first sounder and the first outlet passage of the second sounder may be parallel to one another.

The first and/or second chamber may further comprise a second outlet passage, the second outlet passage being arranged such that, in use, it is aligned with a longitudinal axis of the strap.

The first and second outlet passages may be continuous such that water can flow straight through the chamber and thus does not accumulate on the sounder.

The first and second outlet passages may extend in opposite directions from the respective sounder.

Longitudinal axes of the first and second outlet passages may be aligned with one another.

The first and/or second chamber may be inclined with respect to the strap. For example, the first and/or second chamber may be inclined at 20 to 40 degrees, and more particularly at approximately 30 degrees.

The first and/or second sounder may comprise a piezoelectric transducer.

The alarm may be further configured to be activated by a panic button.

As described above, the personal safety device is able to maintain a sufficiently loud output even in the exceptional conditions tested under NFPA1982. Moreover, this is achieved without requiring additional sounders located on the back of the wearer.

In accordance with another exemplary embodiment of the invention, there is provided a personal safety device, comprising: a housing; a motion sensor arranged to monitor the motion of the wearer; and an alarm configured to be activated when the motion sensor has not detected motion for a predetermined period of time; wherein the alarm comprises: a first sounder disposed within a first chamber formed by the housing, the first chamber having an outlet passage; and a second sounder disposed within a second chamber formed by the housing, the second chamber having an outlet passage; wherein the outlet passage of the first sounder opposes the outlet passage of the second sounder.

A personal safety device as described above may be supplied with breathing apparatus.

The breathing apparatus may comprise a harness arranged to support a cylinder of breathable gas, the harness comprising: a structural support member; and a cylinder retaining mechanism for coupling the cylinder to the structural support member. The alarm may further comprise an additional sounder disposed within a chamber formed by the structural support member, the chamber having first and second outlet passages extending in opposite directions from the additional sounder.

The additional sounder may be located substantially in the centre of the structural support member such that it lies over the spine of a wearer and is disposed between the structural support member and the cylinder.

In accordance with another exemplary embodiment of the invention, there is provided a harness for breathing apparatus, the harness arranged to support a cylinder of breathable gas, the harness comprising: a structural support member; a cylinder retaining mechanism for coupling the cylinder to the structural support member; and a sounder disposed in a chamber formed by the structural support member; wherein the chamber has first and second outlet passages extending in opposite directions from the sounder.

The sounder may be located substantially in the centre of the structural support member such that it lies over the spine of a wearer and is disposed between the structural support member and the cylinder.

The first and second outlet passages may extend laterally from the sounder.

The harness may further comprise a cover which is connected to the structural support member and is spaced from the sounder to define the chamber.

The cover may be arranged so as to abut the cylinder.

The first and second outlet passages provide redundancy, allowing the sound from the sounder to be emitted from the chamber even if one of the openings is muffled, for example, if the wearer were to fall down in distress.

The cylinder protects the sounder both physically and thermally. In particular, the cylinder prevents the openings from becoming muffled even when the wearer is lying on their back. Further, the cylinder acts a thermal barrier and a heat sink for the sounder which prevents it from being damaged by high temperatures. The adiabatic cooling of the cylinder created as the breathable gas is consumed also acts to cool the sounder.

A harness as described above may be used with a personal safety device. The personal safety device may comprise: a motion sensor arranged to monitor the motion of the wearer; with the sounder of the structural support member being configured to be activated when the motion sensor has not detected motion for a predetermined period of time.

The invention may comprise any combination of the features and/or limitations referred to herein, except combinations of such features as are mutually exclusive.

Figure 2:
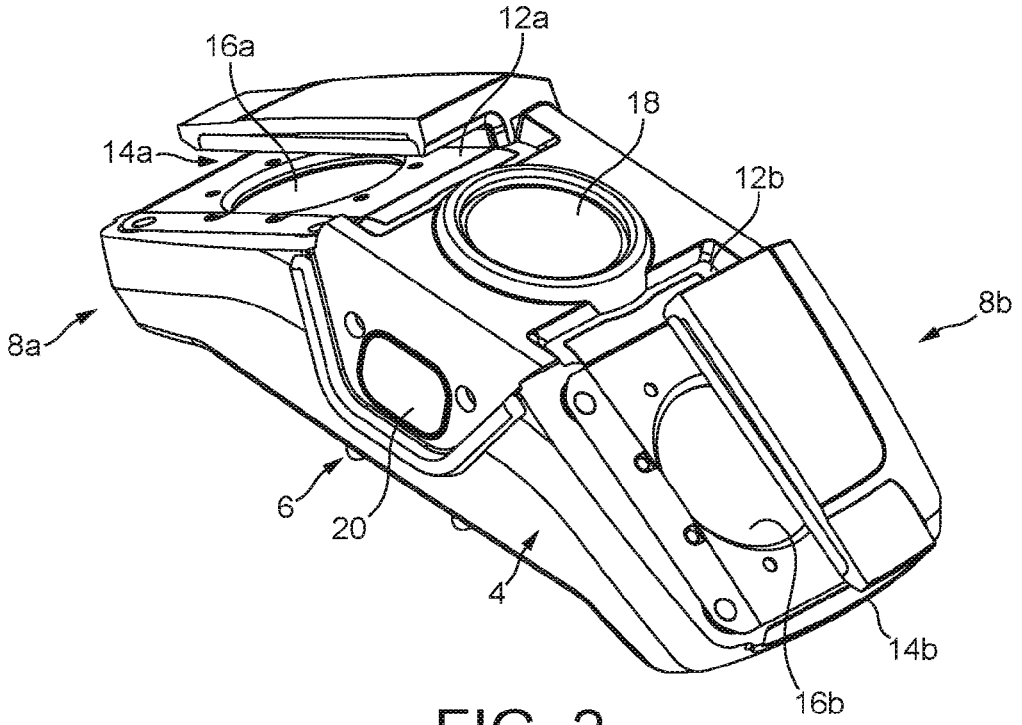
FIG. 2 is a perspective view of the personal safety device showing an portion of the housing cut away.

With reference to FIGS. 1 and 2, there is provided a personal safety device 2. The personal safety device 2 is a standalone unit which is battery-powered. The personal safety device 2 comprises a housing 4 having a central portion 6 and first and second sounder portions 8*a*, 8*b*.

The first sounder portion 8*a* comprises a chamber 10*a* formed by the housing 4. The chamber 10*a* has a first opening 12*a* adjacent the central portion 6 and a second opening 14*a* spaced from the central portion 6, at the periphery of the device 2. The chamber 10*a* forms a continuous conduit between the first opening 12*a* and the second opening 14*a*. The chamber 10*a* has a substantially rectangular cross-section which is uniform between the first opening 12*a* and the second opening 14*a*.

A sounder 16*a* (see FIG. 2) is provided within the chamber 10*a*. The sounder 16*a* is located in a recess in the housing midway between the first and second openings 12*a*, 14*a* of the chamber 10*a*. Accordingly, the chamber 10*a* forms a first outlet passage between the sounder 16*a* and the first opening 12*a*, and a second outlet passage between the sounder 16*a* and the second opening 14*a*.

The sounder 16*a* comprises a piezoelectric transducer. The application of an oscillating voltage to the piezoelectric material causes the material to vibrate. The vibration of the piezoelectric material disturbs the surrounding air, thus creating a sound. The sound from the sounder 16*a* can pass along either or both of the first and second outlet passages and exit the chamber 10*a* via the first and/or second openings 12*a*, 14*a*.

The chamber 10*a* is inclined such that, when the personal safety device 2 is horizontal, the first opening 12*a* is elevated above the second opening 14*a*. The chamber 10*a* is inclined at approximately 30 degrees from horizontal.

Similarly, the second sounder portion 8*b* comprises a chamber 10*b* formed by the housing 4. The chamber 10*b* has a first opening 12*b* adjacent the central portion 6 and a second opening 14*b* spaced from the central portion 6, at the periphery of the device 2. The chamber 10*b* forms a continuous conduit between the first opening 12*b* and the second opening 14*b*. The chamber 10*b* has a substantially rectangular cross-section which is uniform between the first opening 12*b* and the second opening 14*b*.

A sounder 16*b* (see FIG. 2) is provided within the chamber 10*b*. The sounder 16*b* is located in a recess in the housing midway between the first and second openings 12*b*, 14*b* of the chamber 10*b*. Accordingly, the chamber 10*b* forms a first outlet passage between the sounder 16*b* and the first opening 12*b*, and a second outlet passage between the sounder 16*b* and the second opening 14*b*.

The sounder 16*b* comprises a piezoelectric transducer having a disc of piezoelectric material. The application of an oscillating voltage to the piezoelectric material causes the material to vibrate. The vibration of the piezoelectric material disturbs the surrounding air, thus creating a sound. The sound from the sounder 16*b* can pass along either or both of the first and second outlet passages and exit the chamber 10*b* via the first and/or second openings 12*b*, 14*b*.

The chamber 10*b* is inclined such that, when the personal safety device 2 is horizontal, the first opening 12*b* is elevated above the second opening 14*b*. The chamber 10*b* is inclined at approximately 30 degrees from horizontal.

The first openings 12*a*, 12*b* of the first and second sounder portions 8*a*, 8*b* are level with one another. Similarly, the second openings 14*a*, 14*b* of the first and second sounder portion 8*a*, 8*b* are level with one another.

As described above, in both the first and second sounder portions 8*a*, 8*b*, the first opening 12*a*, 12*b* is elevated above the second opening 14*a*, 14*b*. In other words, the chamber 10*a* of the first sounder portion 8*a* and the chamber 10*b* of the second sounder portion 8*b* are inclined in opposite directions. Therefore, the chambers 10*a*, 10*b* are angled with respect to one another at an angle of approximately 120 degrees. The chambers 10*a*, 10*b* are otherwise parallel to one another such that the first openings 12*a*, 12*b* and the second openings 14*a*, 14*b* of the first and second sounder portions 8*a*, 8*b* are all aligned.

The central portion 6 is provided between the first and second sounder portions 8*a*, 8*b*. The central portion 6 comprises a panic button 18 located on a front surface of central portion 6, and a pair of side buttons 20 located on side surfaces of the central portion 6.

Although not shown in FIGS. 1 and 2, the central portion 6 may also comprise a number of indicator lights. For example, the indicator lights may comprise a low-battery indicator, a power indicator, and a wireless connectivity indicator (see FIGS. 5 and 6). A visual alarm, such as a strobe, may also be provided on the central portion 6 and/or on the first and second sounder portions 8*a*, 8*b*.

The personal safety device 2 comprises a motion sensor (not shown) that is configured to activate the sounders 16*a*, 16*b* under certain circumstances, which will be described in detail below.

Figure 3:
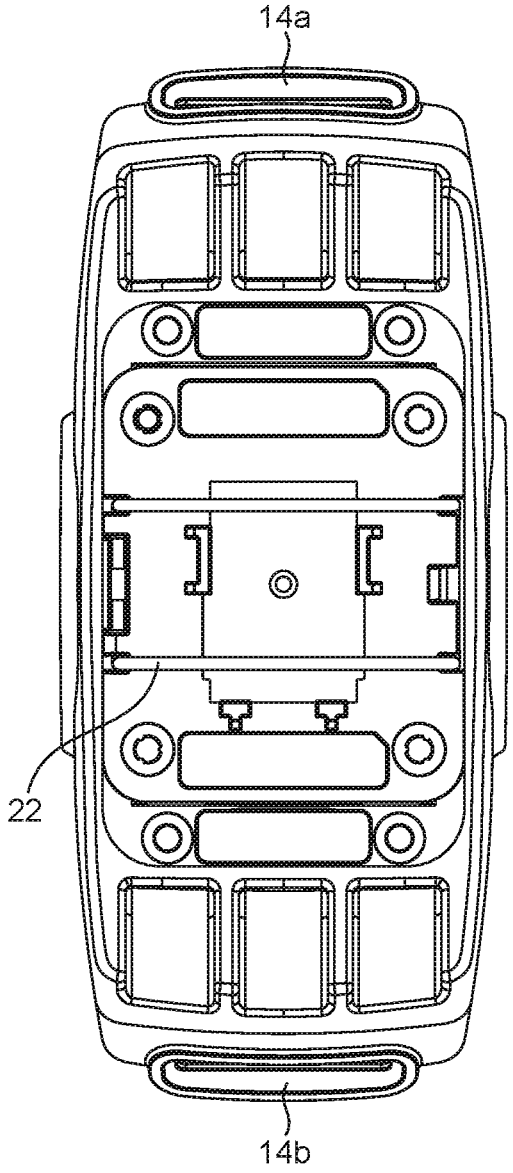
FIG. 3 is a rear view of the personal safety device showing a first type of clip.

With reference now to FIG. 3, a rear surface of the housing 4 is provided with an attachment means. The attachment means comprises a latch 22. One side of the latch 22 is pivotably coupled to the rear surface of the housing 4. The other side of the latch 22 can be received by a recess in the rear surface of the housing 4, where it is snap-fitted in place.

When the latch is not snap-fitted in place, the latch 22 is free to pivot away from the rear surface of the housing 4. This allows a strap to be received between the latch 22 and the rear surface of the housing 4, as will be described in further detail below. The strap may be part of a breathing apparatus harness.

With the strap captured between the latch 22 and the rear surface of the housing 4, the latch 22 can be snap-fitted in place so as to attach the personal safety device 2 to the strap.

Figure 4:
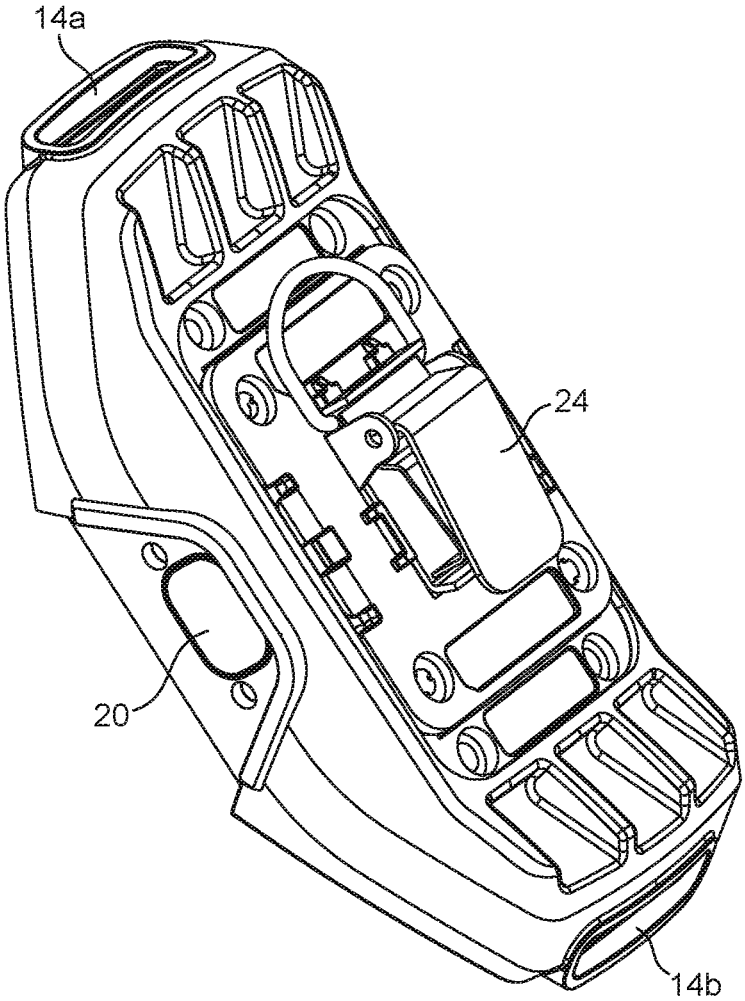
FIG. 4 is a rear perspective view of the personal safety device showing a second type of clip.

The latch 22 is detachably coupled to the housing 4 such that it can be removed and replaced with an alligator clip 24, as shown in FIG. 4. The alligator clip 24 can be used to attach the personal safety device to the clothing of a wearer, particularly where the wearer is not using breathing apparatus.

Figure 5:
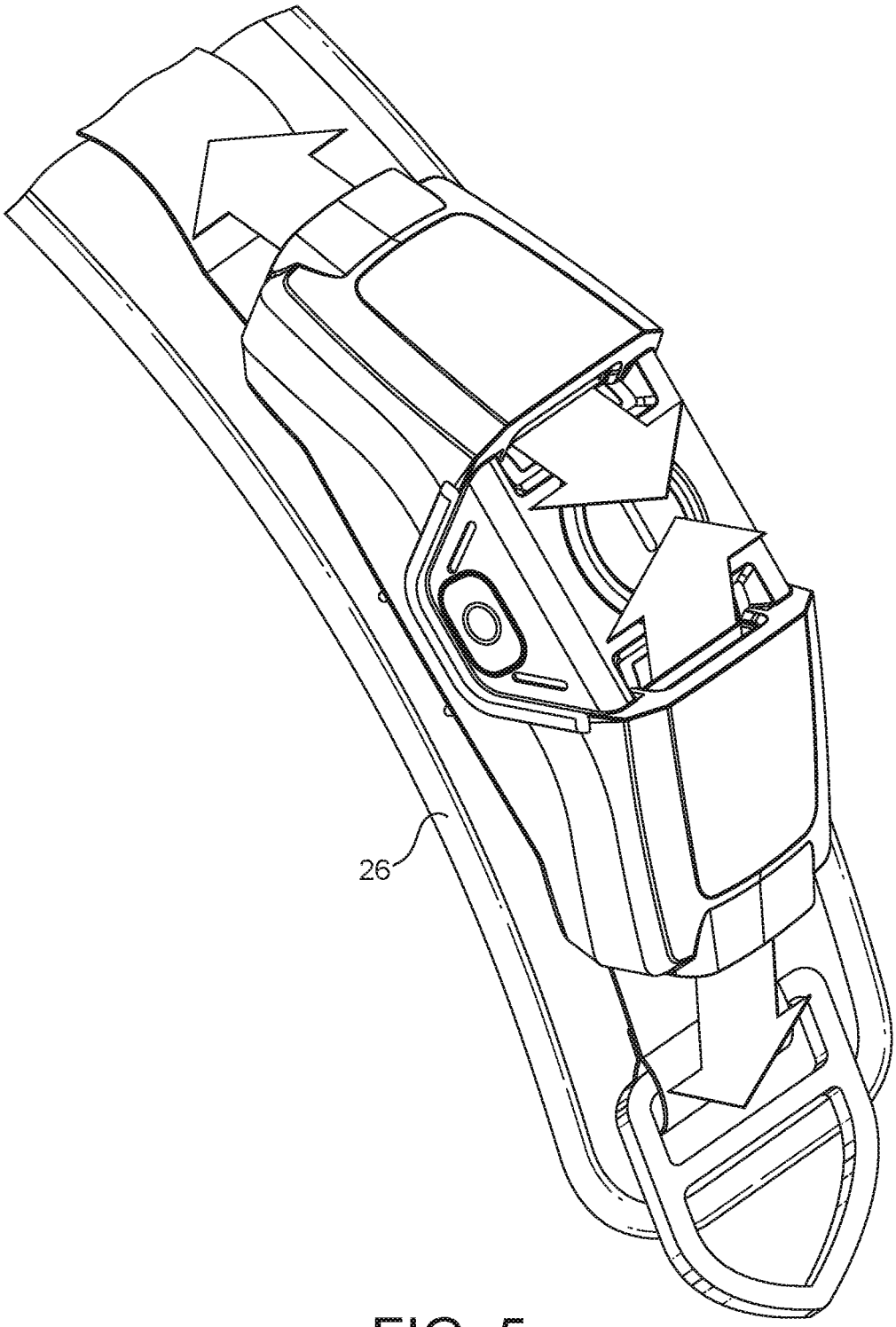
FIG. 5 is a perspective view of the personal safety device attached to a shoulder strap.
Figure 6:
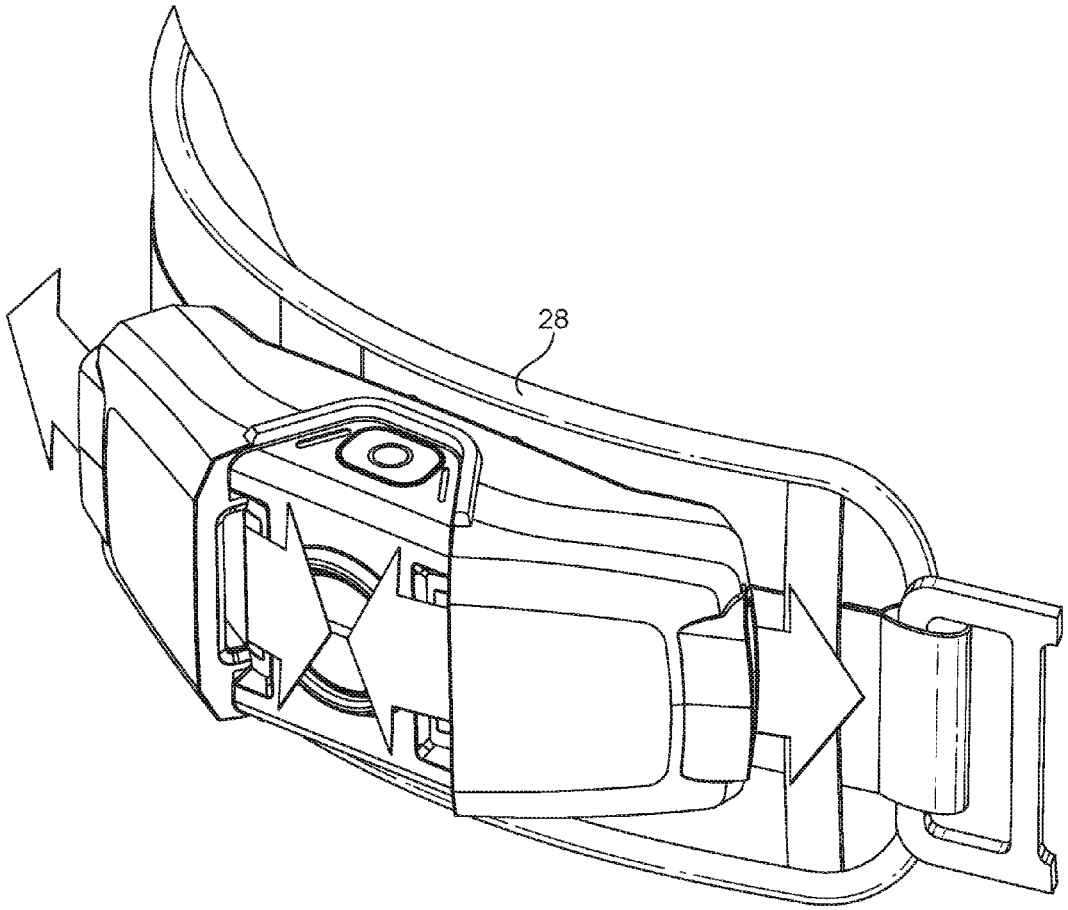
FIG. 6 is a perspective view of the personal safety device attached to a waist strap.

The latch 22 can be used to attach the personal safety device 2 to a shoulder strap 26, as shown in FIG. 5, or a waist strap 28, as shown in FIG. 6, of a breathing apparatus harness. When the personal safety device 2 is attached to a shoulder strap 26, the longitudinal axis of each of the chambers 10*a*, 10*b* is oriented vertically. On the other hand, when the personal safety device 2 is attached to a waist strap 28, the longitudinal axis of each of the chambers 10*a*, 10*b* is oriented horizontally.

As shown in FIGS. 5 and 6, the personal safety device 2 is attached to the strap so that is extends along the length of the strap. Consequently, the chambers 10*a*, 10*b* of the first and second sounder portions 8*a*, 8*b* are aligned with a longitudinal axis of the strap. As indicated by the arrows in FIGS. 5 and 6, the first and second openings 12, 14 of the first and second sounder portions 8*a*, 8*b* are in line with the strap.

The personal safety device 2 is switched on by depressing one or both of the side buttons 20. For example, it may be necessary to depress both of the side buttons 20 at the same time in order to turn the personal safety device 2 on or off. This may avoid the personal safety device 2 being accidentally turned off. Alternatively, the personal safety device 2 may be automatically activated by a suitable trigger, such as the removal of a tally from the personal safety device 2.

Once activated, the motion sensor of the personal safety device 2 monitors the motion of the wearer. If motion is not detected for a pre-determined period of time, the personal safety device 2 may enter a pre-alarm mode, which may comprise visual and/or audible signals. For example, the sounders 16*a*, 16*b* may emit a warning sound to indicate to the wearer that the pre-alarm mode has been activated. The lack of detection of movement may indicate that the wearer is in distress. If the wearer is not in fact in distress, it may be possible to cancel this pre-alarm mode manually by pressing a button or a combination of buttons on the personal safety device 2, such as the panic button 18 or the side buttons 20. The pre-alarm may also be cancelled if the motion sensor detects movement of the wearer. However, if the pre-alarm mode is not cancelled, and motion is not detected for a further period of time, the personal safety device 2 may enter a full-alarm mode, where a loud noise is generated by the sounders 16*a*, 16*b*.

For example, after 20-30 seconds without motion and a further 5-10 seconds without cancellation, the personal safety device 2 may enter the full-alarm mode. These timings may be configured either on the personal safety device 2 itself or by connecting the personal safety device 2 to a computer or other suitable device.

If no motion is detected it may indicate that the wearer is injured or incapacitated and therefore the alarm may alert rescue personnel (other fire-fighters, for example) to the location of the wearer. The full-alarm mode may also be entered manually by depressing the panic button 18. The panic button 18 may be used by the wearer if they become distressed and anticipate that they may require assistance.

The personal safety device 2 may also be provided with a thermal alarm which triggers the sounders 16*a*, 16*b* when the ambient temperature rises rapidly or exceeds safe levels, making it unsafe for the wearer to remain in that environment.

The personal safety device 2 may connect wirelessly to a base station. The personal safety device 2 may transmit an alert to the base station to indicate that the full-alarm mode has been triggered, thus allowing appropriate action can be taken. Further, the base station may transmit an evacuation signal to the personal safety device 2 which triggers the alarm and indicates to the wearer that they should immediately evacuate the scene.

When the sounders 16*a*, 16*b* are activated (i.e. in full-alarm mode), sound exits the chambers 10*a*, 10*b* via the first and second openings 12, 14. As the first and second openings 12, 14 are aligned with a longitudinal axis of the strap, the turn-out gear, particularly the jacket, of the wearer is prevented from covering the openings 12, 14. In particular, the padding of the strap acts to shield the personal safety device 2 from the turn-out jacket.

Further, the opposing arrangement of the first openings 12*a*, 12*b* of the first and second sounder portions 8*a*, 8*b* provides mutual protection to the openings and prevents them from being obstructed by the turn-out gear of the wearer.

As the chamber 10*a* of the first sounder portion 8*a* is angled with respect to the chamber 10*b* of the second sounder portion 8*b*, water is always able to drain from one of the chambers 10*a*, 10*b*, regardless of the orientation of the personal safety device 2. Further, water can flow straight through the chamber 10*a*, 10*b* and thus does not accumulate on the sounder 16*a*, 16*b*.

As described above, the angular arrangement of the chambers 10*a*, 10*b* ensures that at least one of the sounders 16*a*, 16*b* will self-drain during the water drainage test imposed by NFPA1982. Further, since the chambers 10*a*, 10*b* are aligned with the strap, they are not blocked by the folds of the turn-out jacket, either at the chest or at the waist, in any of the positions prescribed by the muffle test.

The personal safety device 2 is therefore able to maintain a sufficiently loud output even in the exceptional conditions tested under NFPA1982. Moreover, this is achieved without requiring additional sounders located on the back of the wearer.

Although the personal safety device 2 has been described as a standalone unit, it may be an integrated removable type unit or an integrated non-removable type unit. For example, the unit may comprise a pressure transducer which is permanently or detachably connected to breathing apparatus. The pressure transducer may be used for monitoring breathing apparatus or for other purposes, such as automatic activation of the personal safety device 2. Alternatively, the pressure transducer may be provided in a separate module, and the output (or processed data) from the pressure transducer supplied to the personal safety device 2 via a wired or wireless connection.

Whilst the personal safety device 2 has been described as having first and second sounders 16*a*, 16*b*, certain advantages of the invention may be realised in an embodiment having only a single sounder.

Figure 7:
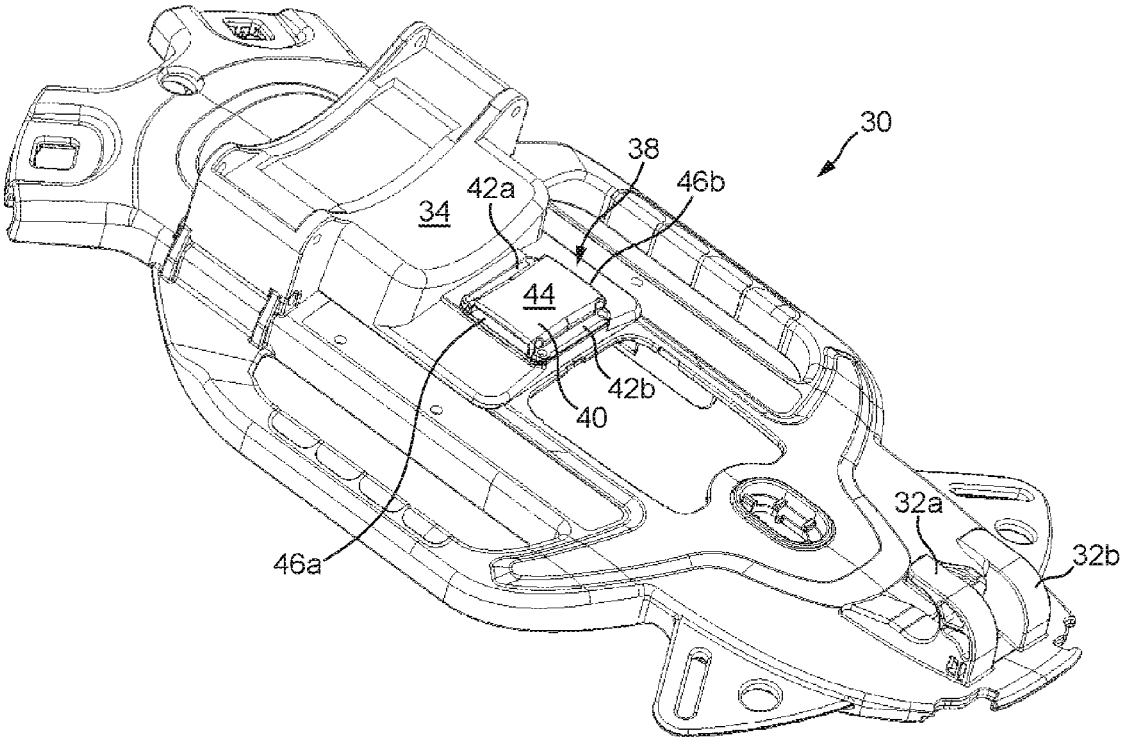
FIG. 7 is a perspective view of a back plate of a harness according to another embodiment of the invention.
Figure 8:
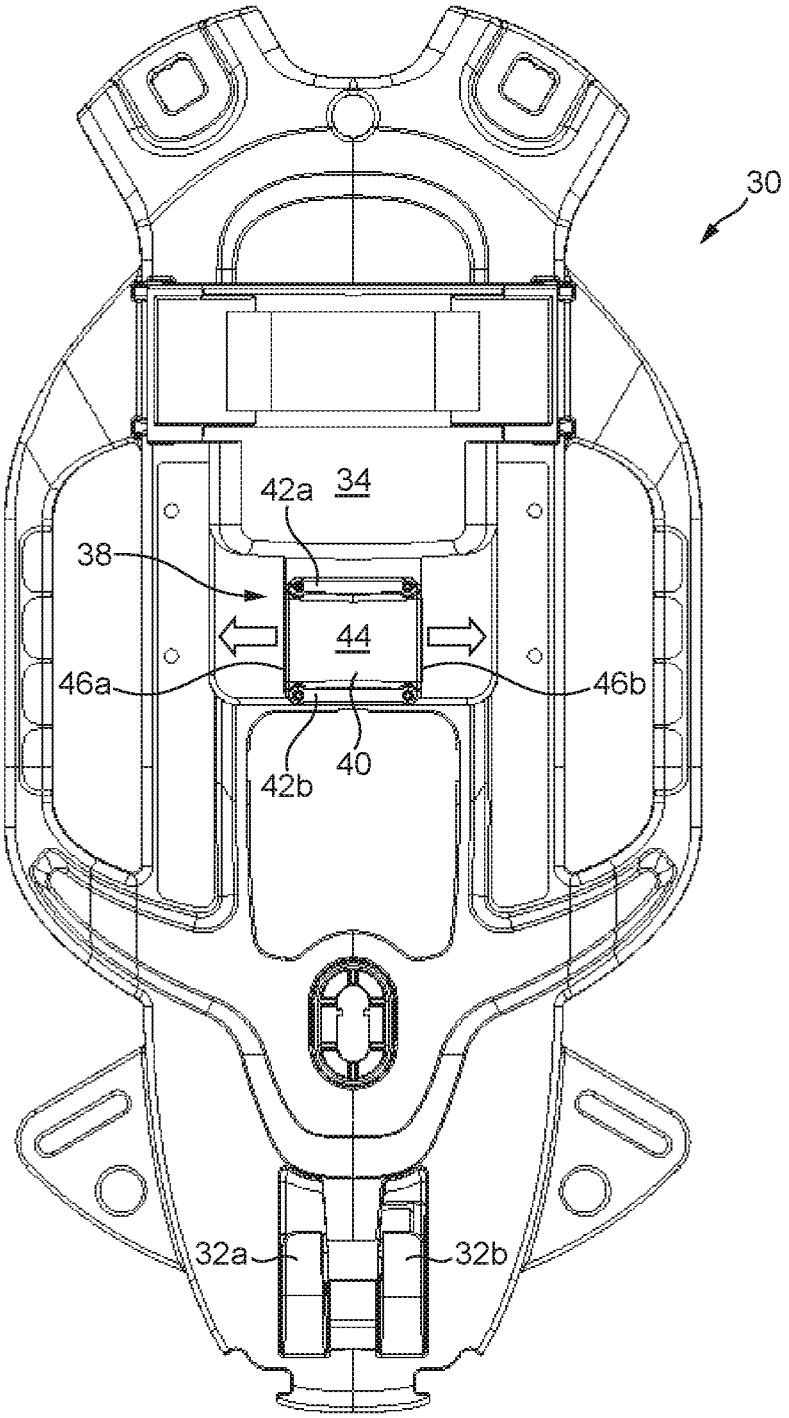
FIG. 8 is a top view of the back plate.
Figure 9:
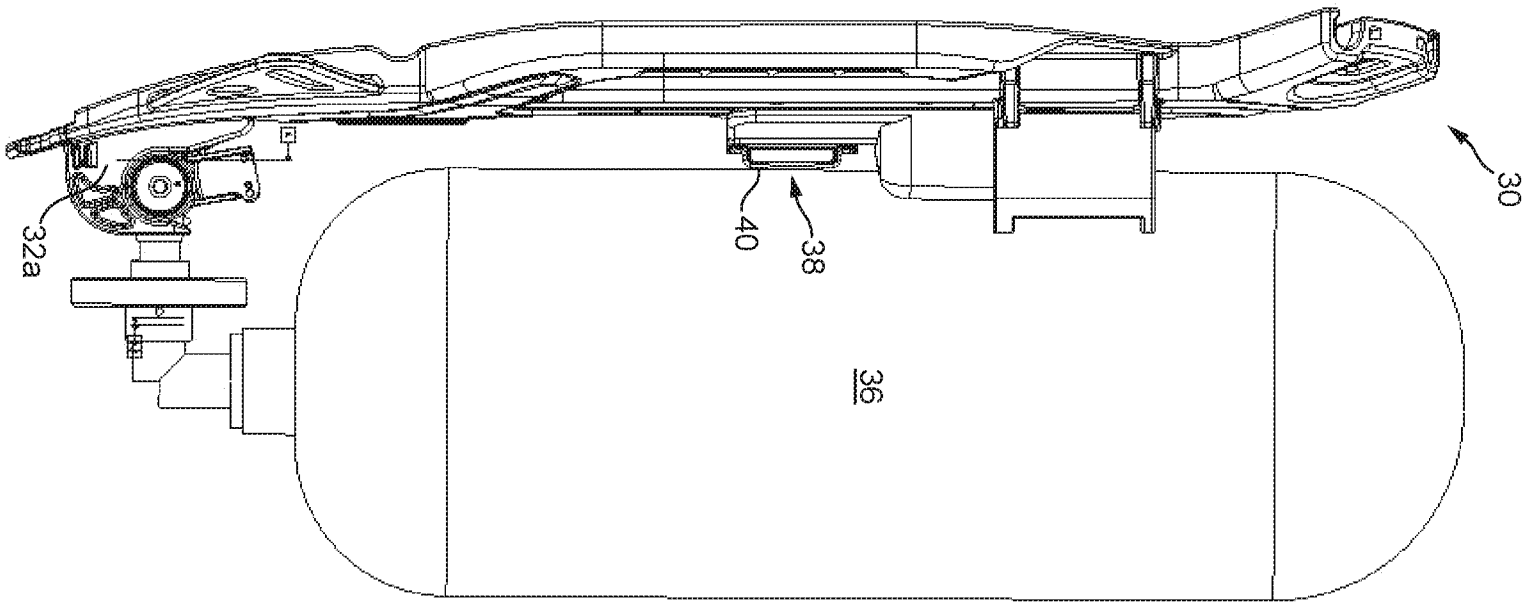
FIG. 9 is a side view of the back plate with a cylinder attached thereto.

The personal safety device 2 may also comprise one or more additional sounders located on a harness of breathing apparatus. FIGS. 7 to 9 show a back plate 30 of a harness which may be used with the personal safety device 2 or with other personal safety devices. For clarity, the back plate 30 is shown without the straps of the harness which would be worn by a wearer such that the back plate 30 is held against the back of the wearer.

The back plate 30 comprises a pair of hooks 32*a*, 32*b* toward a lower end of the back plate 30 and a profiled support 34 toward an upper end of the back plate 30. As shown in FIG. 9, the hooks 32*a*, 32*b* receive and support an end of a cylinder 36 containing breathable gas such that the cylinder 36 extends along a longitudinal axis of the back plate 30. The cylinder 36 lies against the profiled support 34 which is shaped to conform approximately to the curvature of the cylinder 36. The profiled support 34 is provided with a pair of pins (not shown) at either side of the profiled support 34 to which a strap (also not shown) is attached. The strap passes over the cylinder 36 before being fastened together using a suitable buckle or other fastener. The strap, hooks 32*a*, 32*b* and profiled support 34 form a retaining mechanism which detachably couples the cylinder 36 to the back plate 30. Of course, it will be appreciated that other arrangements may be used for retaining the cylinder 36 and that the back plate 30 may take other forms, provided it serves as a structural support member for the harness.

The back plate 30 comprises a sounder assembly 38 located substantially in the centre of the back plate 30, i.e. along the longitudinal axis of the back plate 30, such that it lies over the spine of the wearer when in use. The sounder assembly 38 is located between the hooks 32*a*, 32*b* and the profiled support 34 and thus is disposed between the back plate 30 and the cylinder 36.

The sounder assembly 38 comprises a sounder (not shown) affixed to the back plate 30. Preferably, the sounder is located within a recess in the back plate 30 so that it lies flush with or below the surface of the back plate 30, but it may also sit above the surface of the back plate 30.

The sounder assembly 38 further comprises a cover 40 which is connected to (and may be integrally formed with) the back plate 30 at upper and lower sides of the sounder by a pair of tabs 42*a*, 42*b*. The cover 40 further comprises a central portion 44 disposed between the tabs 42*a*, 42*b*. The central portion 44 is raised up from the tabs 42*a*, 42*b*. For example, the central portion 44 may be connected to the tabs 42*a*, 42*b* by upright side walls or may be curved upwards (i.e. arched or vaulted) between the tabs 42*a*, 42*b*. The central portion 44 is therefore spaced from the surface of the back plate 30 and the sounder. The central portion 44 may abut against the cylinder 36. In particular, the central portion 44 may be physically touching the cylinder 36 in order to improve thermal conductivity. Alternatively, the central portion 44 may lie adjacent to the cylinder 36 but not in direct contact with the cylinder 36.

The cover 40 forms a chamber in which the sounder is disposed. The chamber is open at both sides, defining a left-side opening 46*a* and a right-side opening 46*b*. The chamber forms a continuous conduit between the left-side opening 46*a* and the right-side opening 46*b*. The chamber has a substantially rectangular cross-section which is uniform between the left-side opening 46*a* and the right-side opening 46*b*.

The sounder is located midway between the left and right-side openings 46*a*, 46*b* of the chamber. Accordingly, the chamber forms a first outlet passage between the sounder and the left-side opening 46*a*, and a second outlet passage between the sounder and the right-side opening 46*b*.

The sounder comprises a piezoelectric transducer. The application of an oscillating voltage to the piezoelectric material causes the material to vibrate. The vibration of the piezoelectric material disturbs the surrounding air, thus creating a sound. The sound from the sounder can pass along either or both of the first and second outlet passages and exit the chamber via the left-side and/or right-side openings 46*a*, 46*b*.

Consequently, the sound from the sounder is emitted from the chamber even if one of the openings 46*a*, 46*b* is muffled, for example, if the wearer were to fall down in distress.

The cylinder 36 protects the sounder assembly 38 both physically and thermally. In particular, the cylinder 36 prevents the openings 46*a*, 46*b* from becoming muffled even when the wearer is lying on their back. Specifically, the cylinder 36 and back plate 30 together effectively define two longitudinally extending channels at either side of the cylinder 36 (i.e. with an outer extent defined by a tangent to the cylinder 36 which is perpendicular to the plane of the back plate 30). These channels prevent material (i.e. the turn-out gear) from coming near to and muffling the openings 46*a*, 46*b*. Further, the cylinder 36 acts a thermal barrier and a heat sink for the sounder which prevents it from being damaged by high temperatures. The adiabatic cooling of the cylinder 36 created as the breathable gas is consumed also acts to cool the sounder.

Although not shown, the back plate 30 may comprise a further sounder assembly which is spaced from the sounder assembly 38 along the longitudinal axis of the back plate 30 and angled relative to the sounder assembly 38. As the sounder assemblies are angled with respect to one another, water is always able to drain from one of the chambers, regardless of the orientation of the back plate 30.

Although the sounder assembly 38 has been described as being located between the hooks 32*a*, 32*b* and the profiled support 34, it may instead be located above the profiled support 34 and the strap toward the top of the back plate 30.

It should be noted that the invention is not limited to piezoelectric sounders and other suitable sounders may be used.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

The invention claimed is:

1. A personal safety device, comprising:

a housing;

attachment means provided on the housing, the attachment means being configured to receive a strap so as to attach the device to a wearer;

a motion sensor arranged to monitor the motion of the wearer; and an alarm configured to be activated when the motion sensor has not detected motion for a predetermined period of time;

wherein the alarm comprises a first sounder disposed within a first chamber formed by the housing, the first chamber having a first outlet passage;

wherein the first outlet passage is arranged such that, in use, it is aligned with a longitudinal axis of the strap.

2. A personal safety device as claimed in claim 1, wherein the alarm further comprises a second sounder disposed within a second chamber formed by the housing, the second chamber having a first outlet passage;

wherein the first outlet passage of the second chamber is arranged such that, in use, it is aligned with a longitudinal axis of the strap.

3. A personal safety device as claimed in claim 2, wherein the first and second chamber are inclined with respect to one another.

4. A personal safety device as claimed in claim 3, wherein the first and second chambers are inclined at 100 to 140 degrees.

5. A personal safety device as claimed in claim 4, wherein the first and second chambers are inclined at 120 degrees.

6. A personal safety device as claimed in claim 2, wherein the first outlet passage of the first sounder opposes the first outlet passage of the second sounder.

7. A personal safety device as claimed in claim 2, wherein the first outlet passage of the first sounder and the first outlet passage of the second sounder are parallel to one another.

8. A personal safety device as claimed in claim 1, wherein the first and/or second chamber further comprises a second outlet passage, the second outlet passage being arranged such that, in use, it is aligned with a longitudinal axis of the strap.

9. A personal safety device as claimed in claim 8, wherein the first and second outlet passages extend in opposite directions from the respective sounder.

10. A personal safety device as claimed in claim 8, wherein longitudinal axes of the first and second outlet passages are aligned with one another.

11. A personal safety device as claimed in claim 1, wherein the first and/or second chamber is inclined with respect to the strap.

12. A personal safety device as claimed in claim 11, wherein the first and/or second chamber is inclined at 20 to 40 degrees.

13. A personal safety device as claimed in claim 12, wherein the first and/or second chamber is inclined at 30 degrees.

14. A personal safety device as claimed in claim 1, wherein the first and/or second sounder comprises a piezoelectric transducer.

15. A personal safety device as claimed in claim 1, wherein the alarm is further configured to be activated by a panic button.

16. Breathing apparatus comprising a personal safety device as claimed in claim 1.

17. Breathing apparatus as claimed in claim 16, wherein the breathing apparatus comprises a harness arranged to support a cylinder of breathable gas, the harness comprising:

a structural support member; and a cylinder retaining mechanism for coupling the cylinder to the structural support member;

wherein the alarm further comprises an additional sounder disposed within a chamber formed by the structural support member, the chamber having first and second outlet passages extending in opposite directions from the additional sounder.

18. Breathing apparatus as claimed in claim 17, wherein the additional sounder is located substantially in the centre of the structural support member such that it lies over the spine of a wearer and is disposed between the structural support member and the cylinder.

19. A harness for breathing apparatus, the harness arranged to support a cylinder of breathable gas, the harness comprising:

a structural support member;

a cylinder retaining mechanism for coupling the cylinder to the structural support member; and a sounder disposed in a chamber formed by the structural support member;

wherein the chamber has first and second outlet passages extending in opposite directions from the sounder.

20. A harness as claimed in claim 19, wherein the sounder is located substantially in the centre of the structural support member such that it lies over the spine of a wearer and is disposed between the structural support member and the cylinder.

21. A harness as claimed in claim 19, wherein the first and second outlet passages extend laterally from the sounder.

22. A harness as claimed in claim 19, wherein the harness further comprises a cover which is connected to the structural support member and is spaced from the sounder to define the chamber.

23. A harness as claimed in claim 22, wherein the cover is arranged so as to abut the cylinder.

24. Breathing apparatus comprising a harness as claimed in claim 19 and a personal safety device, the personal safety device comprising:

a motion sensor arranged to monitor the motion of the wearer; and wherein the sounder of the structural support member is configured to be activated when the motion sensor has not detected motion for a predetermined period of time.

* * * * *